US007077683B1

(12) United States Patent
Ross

(10) Patent No.: US 7,077,683 B1
(45) Date of Patent: Jul. 18, 2006

(54) RATCHETING ELECTRICAL PLUG AND RECEPTACLE

(76) Inventor: Nicky Charles Ross, 8261 Winkler Way, Sacramento, CA (US) 95828

( * ) Notice: Subject to any disclaimer, the term of this patent is extended or adjusted under 35 U.S.C. 154(b) by 0 days.

(21) Appl. No.: 11/153,992

(22) Filed: Jun. 15, 2005

(51) Int. Cl.
*H01R 13/625* (2006.01)

(52) U.S. Cl. ..... 439/346

(58) Field of Classification Search ..... 439/346, 439/265, 373
See application file for complete search history.

(56) References Cited

U.S. PATENT DOCUMENTS 2,476,510 A * 7/1949 Rosner ..... 439/265
4,063,790 A * 12/1977 Kleykamp et al. ..... 439/191
4,085,991 A * 4/1978 Marshall et al. ..... 439/346
4,662,697 A * 5/1987 Moses ..... 439/148
5,316,493 A * 5/1994 Sowers ..... 439/346
5,318,458 A * 6/1994 Thorner ..... 439/427
5,630,726 A * 5/1997 Baldwin ..... 439/346
5,692,921 A * 12/1997 Jennings ..... 439/346
5,791,931 A * 8/1998 Burkhart, Sr. ..... 439/346
6,171,129 B1 * 1/2001 Phillips ..... 439/346
6,273,738 B1 * 8/2001 Kajiwara ..... 439/259
6,676,428 B1 * 1/2004 Burton ..... 439/270
6,855,012 B1 * 2/2005 An ..... 439/793

* cited by examiner

*Primary Examiner*—Gary F. Paumen
*Assistant Examiner*—Larisa Tsukerman
(74) *Attorney, Agent, or Firm*—Risto A. Rinne, Jr.

(57) ABSTRACT

An apparatus for securing an electrical male plug to a female receptacle includes a serrated edge on at least one pin of the plug that cooperates with a retaining member in the receptacle. Linear insertion of the plug into the receptacle allows a portion of the retaining member to engage with at least one sawtooth of the serrated edge sufficient to secure the plug thereto until the retaining member is urged from a first position into a second position, the second position being adapted for release of the retaining member from the serrated edge, at which time the plug can be linearly withdrawn from the receptacle. Fixed-in-position as well as portable extension cord use is described.

15 Claims, 5 Drawing Sheets

RATCHETING ELECTRICAL PLUG AND RECEPTACLE

BACKGROUND OF THE INVENTION

1. Field of the Invention

The present invention, in general relates to electrical plugs and, more particularly, to an electrical plug for insertion into a receptacle that resists inadvertent removal thereof.

Anyone who has ever pulled on an electric hand drill or vacuum or any other electrically powered device that runs on household current is well aware of the fact that cords have a limited overall length and when you pull more than the length allows the device becomes unplugged.

Accordingly, plugs that resist withdrawal by friction or other means are known, but have retained certain disadvantages. For example, securement of a plug in a socket (i.e., receptacle) by friction makes removal difficult to accomplish when desired.

It is also desirable to have a neat appearance where locking occurs automatically upon insertion of the plug into the receptacle. Other objects are also important, as are described hereinafter.

Another crucial need is for any solution to be compatible with prior types of electrical plugs sufficient to receive the prior type of plug and to provide current thereto. Of course, the prior type of plug would not necessarily be secured to the receptacle in the same way that a new and improved type of plug would be, however it is important that the prior type of plug at least function when it is inserted in the new type of receptacle.

Accordingly, there exists today a need for a ratcheting electrical plug and receptacle that is adapted for retaining a plug in a receptacle (socket) that allows for easy insertion, locking, and release thereof.

Clearly, such an apparatus would be a useful and desirable device.

2. Description of Prior Art

Plugs that insert, twist and then lock in position are, in general, known. Also, a friction based plug with a button release is believed to be available under the tradename YELLOW JACKET and as shown on the Internet at www-.woods.com.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a ratcheting electrical plug and receptacle that is easy to insert into a receptacle socket.

It is also an important object of the invention to provide a ratcheting electrical plug and receptacle that includes a new type of receptacle that is adapted for use with older types of plugs that include the same basic configuration (i.e., contact pin arrangement).

Another object of the invention is to provide a ratcheting electrical plug and receptacle that includes a new type of electrical plug that is adapted for use with older types of receptacles that include the same basic configuration (i.e., contact pin arrangement).

Still another object of the invention is to provide a ratcheting electrical plug and receptacle that includes an electrical plug that includes a ground pin and wherein the ground pin includes a plurality of longitudinal serrations.

Still yet another object of the invention is to provide a ratcheting electrical plug and receptacle that includes a receptacle that includes a retaining member that is adapted to automatically engage with a plurality of serrations provided in a ground pin of a plug.

Yet another important object of the invention is to provide a ratcheting electrical plug and receptacle that includes an electrical plug with at least one male connector pin extending from the plug and including at least one serration in the connector pin.

Still yet another important object of the invention is to provide a ratcheting electrical plug and receptacle that includes an electrical plug with at least one male connector pin extending from the plug and including a plurality of serrations in the connector pin.

A first continuing object of the invention is to provide a ratcheting electrical plug and receptacle that includes a receptacle that includes a retaining member that is adapted to automatically engage with at least one serration that is provided in a pin of an electrical plug.

A second continuing object of the invention is to provide a ratcheting electrical plug and receptacle that includes a receptacle that includes a retaining member that is adapted to automatically engage with a plurality of serrations provided in a pin of an electrical plug.

A third continuing object of the invention is to provide a ratcheting electrical plug and receptacle that includes an electrical plug that is adapted for use on an end of an electrical cord that is attached to an electrical appliance (i.e., device) and which supplies power to the appliance.

A fourth continuing object of the invention is to provide a ratcheting electrical plug and receptacle that includes an electrical plug that is adapted for use on an end of an electrical extension cord.

A fifth continuing object of the invention is to provide a ratcheting electrical plug and receptacle that includes an electrical receptacle that includes a retaining member which is adapted to automatically engage with a serration provided in a pin of a plug and wherein the electrical receptacle is adapted for use on an end of an electrical extension cord.

A sixth continuing object of the invention is to provide a ratcheting electrical plug and receptacle that includes an electrical plug that is adapted for use with a prior art type of a receptacle.

A seventh continuing object of the invention is to provide a ratcheting electrical plug and receptacle that includes a receptacle that is adapted for use with a prior art type of an electrical plug.

Briefly, a ratcheting electrical plug and receptacle that is constructed in accordance with the principles of the present invention includes an electrical plug with at least one pin connector that includes a serrated edge and wherein the serrated edge of the connector is adapted to engage with a retaining member in a receptacle that automatically engages with the serrated edge when the plug is inserted in a first longitudinal direction and without rotation into the receptacle. Manual release of the retaining member is first required to permit the withdrawal of plug from the receptacle in a second longitudinal direction that is opposite the first longitudinal direction. A preferred location for the serrated edge is on a ground connector pin of the plug. The receptacle may be disposed at one end of an electrical extension cord or it may be fixedly attached, such as to a wall as part of duplex receptacle. The plug may be disposed at an opposite end of the extension cord or it may be attached to an end of an electrical cord that is used to supply electrical power to an electrical device. The plug is adapted for non-ratcheting use with a prior art type of a receptacle. The receptacle is adapted for non-ratcheting use with a prior art type of an electrical plug.

DETAILED DESCRIPTION OF THE INVENTION

Figure 1:
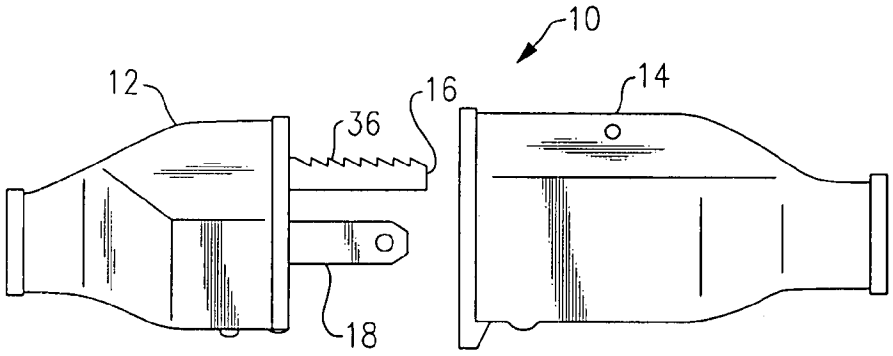
FIG. 1 is a side view of a ratcheting electrical plug and receptacle in a spaced-apart orientation.

Referring on occasion to all of the drawings and in particular now to FIGS. 1–4 is shown, a ratcheting electrical plug and receptacle, identified in general by the reference numeral 10.

Together, they form a system that allows easy insertion of an electrical plug 12 portion into an electrical receptacle 14 portion of the electrical plug and receptacle 10 system and which retains the plug 12 in both electrical and mechanical cooperation with the receptacle 14.

The procedures for insertion and release are each described in greater detail hereinafter.

The electrical plug 12 and the receptacle 14 include any preferred configuration or type of alternating current and voltage electrical connector as is well known in the residential and commercial electrical power wiring arts. The configuration utilized will vary depending upon the voltage, current, and location (i.e., the country) of use.

The configuration that is shown for the electrical plug and receptacle 10 system is compatible for use with a domestic, conventional grounded 120 VAC type of electrical connection, such as is most commonly used in homes and commercial properties and described in the National Electrical Code (NEC).

However, this particular example is only for purpose of illustration and is not intended as a limitation. Those possessing ordinary skill in the art, after having had benefit of the instant disclosure, will be able to modify any configuration of electrical plug and electrical outlet (receptacle) to utilize the teachings herein.

Additionally, the use of the term "receptacle 14" is intended to include any female type of receptacle, socket, or outlet including but not limited to those found on extension cords, duplex receptacles, and other fixed-in-position types of receptacles. Similarly, the use of the term "plug 12" is intended to include any male type of an electrical connector that is adapted to mate with the corresponding female type of receptacle, as is also well known in the alternating current wiring arts.

The plug 12 includes a ground pin 16, a neutral pin 18, and a hot pin 20. The pins 16–20 include any preferred size and shape that is in accordance with the prevailing NEC or other applicable standard.

The receptacle 14 includes a corresponding ground socket 22, a neutral socket 24, and a hot socket 26 that are each adapted to receive the corresponding pins 16–20, respectively. Typically, the neutral socket 24 includes a longer length of opening than does the hot socket 26 to ensure proper mating of the plug 12 with the receptacle 14.

A plug end of a first electrical cord 28 is attached to the plug 12 and a receptacle end of a second electrical cord 30 is attached to the receptacle 14.

If the first electrical cord 28 (which includes the plug 12) is attached at an opposite end thereof to an electrical device (for example a drill or a vacuum cleaner, etc., -not shown) and the second electrical cord 30 is securely attached to a duplex type of a ratcheting electrical receptacle 200 (FIG. 6, and which is described in greater detail hereinafter), then a secure mechanical and electrical connection that prevents the first electrical cord 28 of either the drill or the vacuum from being inadvertently separated apart (i.e., pulled apart) from the second electrical cord 30 is provided. This is described in greater detail hereinafter.

Figure 2:
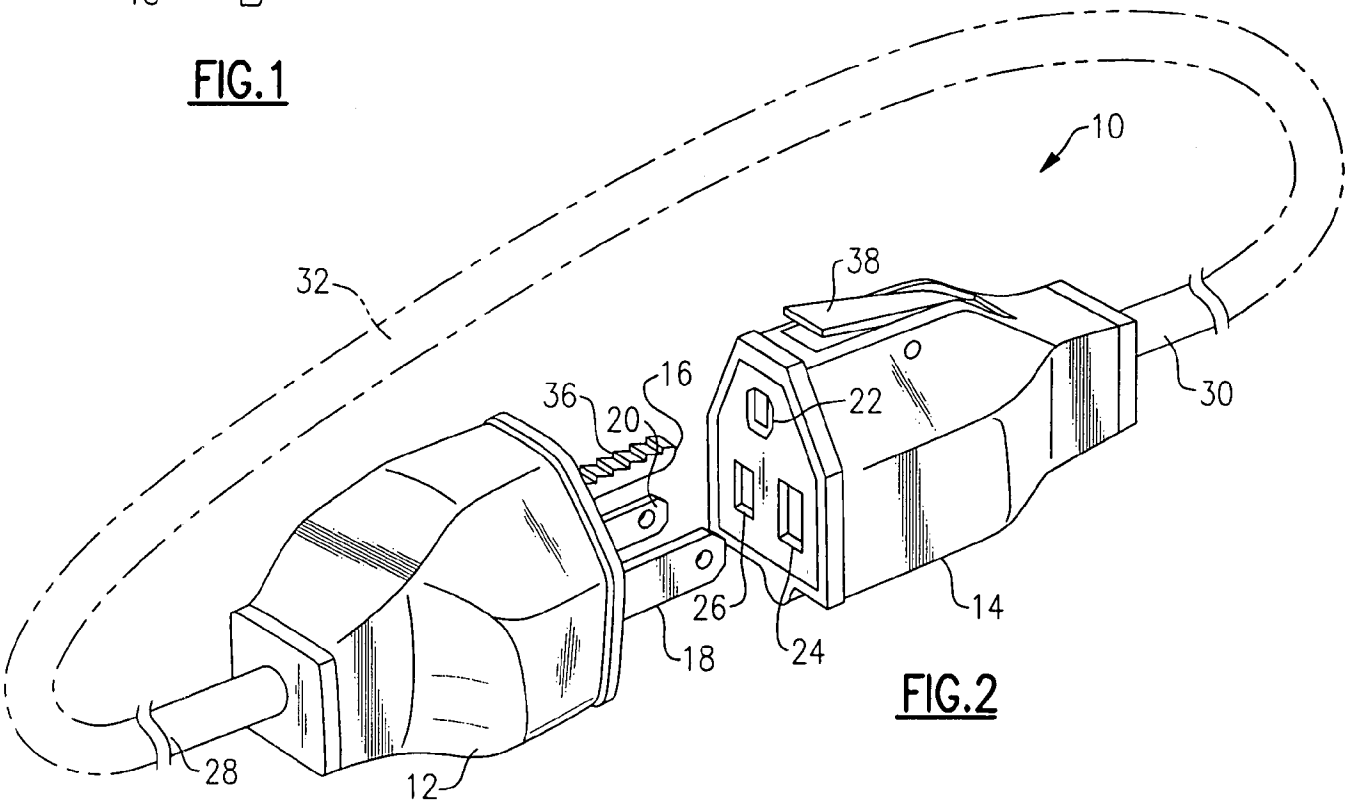
FIG. 2 is a view in perspective of the ratcheting electrical plug and receptacle of FIG. 1 with a retaining member of the receptacle disposed in a second, or released, position and with a first electrical cord attached to the plug and a second electrical cord attached to the receptacle.

Similarly, if the receptacle 14 is attached to the receptacle end of the second electrical cord 30 and another plug 12 is attached at the opposite end of the second electrical cord, then a ratcheting extension cord 32 is provided. This is illustrated in FIG. 2 by assuming that a portion of the second electrical cord 30, as is shown in dashed lines, extends for a predetermined distance and is electrically connected to the first electrical cord 28. This produces the ratcheting extension cord 32.

The plug 12 of the ratcheting extension cord 32 would normally be inserted into the duplex electrical receptacle 200 and the ratcheting extension cord would therefore be secured to the duplex electrical receptacle 200. If whatever device was being used also included the plug 12, then means for extending the distance that electrical power is supplied to the device is provided. Obviously, a ganging in series of two or more ratcheting electrical cords 32 would allow as much extension distance as was desired.

Of course, it is possible to retrofit any or all existing devices (drills, vacuums, etc.) with the plug 12. Accordingly, it is expected that the plug 12 will be sold alone as a component part of the electrical plug and receptacle 10 system.

In like manner, the receptacle 14 is expected to be sold, either alone or also in combination with the plug 12 for attachment to existing prior art types of extension cords (not shown) thereby replacing the existing prior art types of plugs and receptacles (not shown) of the prior art types of extension cords.

Figure 3:
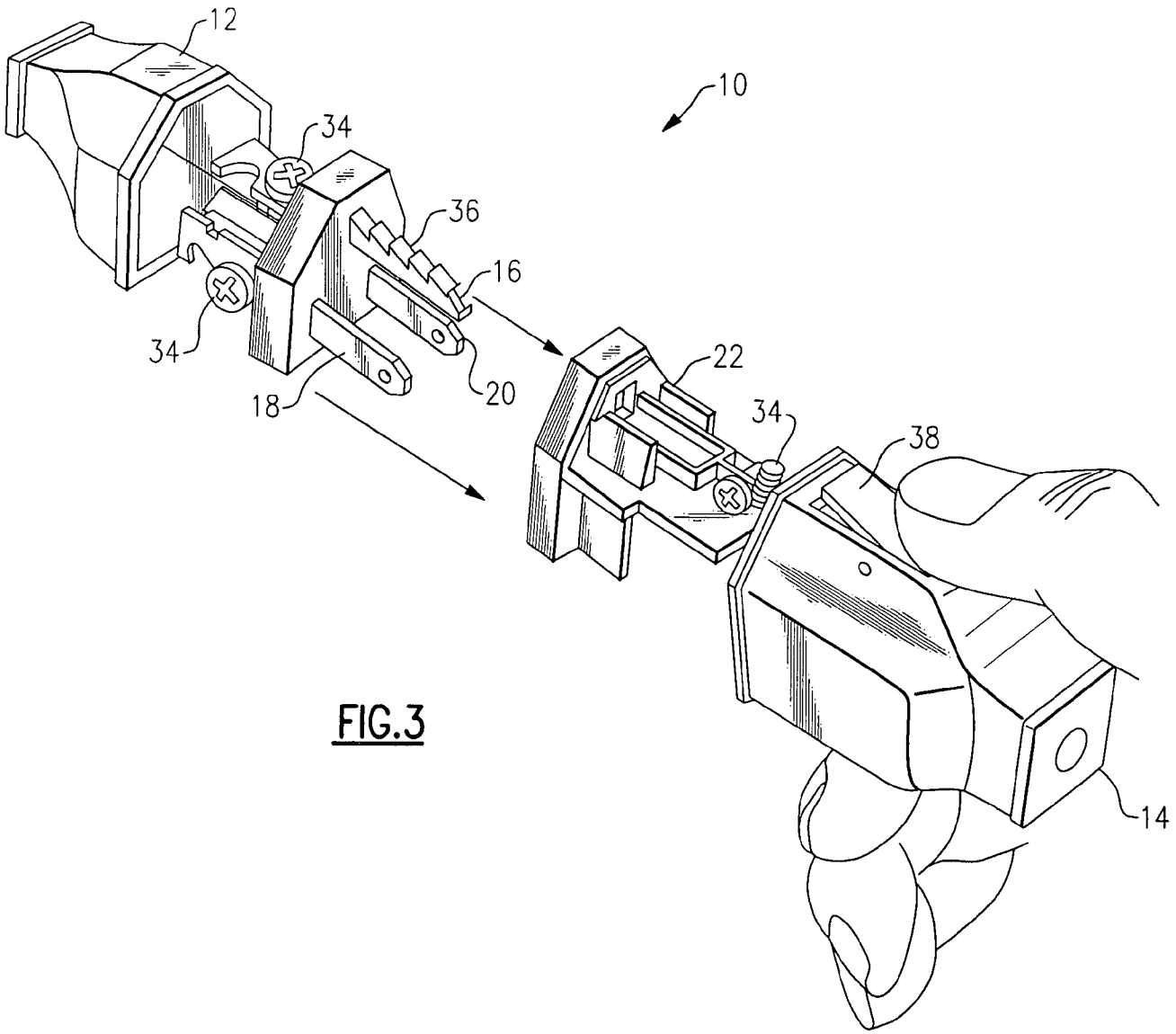
FIG. 3 is an exploded view in perspective of the ratcheting electrical plug and receptacle of FIG. 1.

The exploded view of FIG. 3 shows how attachment of the conductors present in the ratcheting electrical cord 32 or in the first and second electrical cords 28, 30 would occur to screws 34 that are mechanically and electrically attached to the pins 16–20 or sockets 22–26 present in either the plug 12 or the receptacle 14.

It is also expected that the ratcheting extension cord 32 will also be sold in various lengths and wire gauges as a variety of finished products.

At least one of the pins 16–20 includes a serrated edge 36 along a longitudinal length thereof. It is preferred that the serrated edge 36 be included on the ground pin 16, although either or both of the remaining electrical contact pins 18, 20 may include a second and third serrated edge 36, as desired. When the serrated edge 36 is on a different pin or if more than one serrated edge 36 is included, the receptacle 14 is of course modified accordingly so as to include a similar plurality of mechanisms, as described hereinafter, necessary to cooperate with the additional serrated edges 36.

The serrated edge 36 must include at least one generally sawtooth shaped contour sufficient to accomplish the retention (as described hereinafter), although a plurality of adjacent contiguous sawtooth shaped serrations along the longitudinal length are preferred to ensure engagement and retention of the plug 12 with the socket 14 regardless of how fully the plug 12 has been inserted into the socket 14.

It is well known that users sometimes do not fully and properly insert prior art types of plugs into prior art types of sockets. The instant invention provides the unexpected benefit of ensuring that even an improper abbreviated insertion of the plug 12 into the receptacle 14 (i.e., of the pins 16–20 into the sockets 22–26) will nevertheless secure and retain the two in mechanical and electrical cooperation with each other. This prevents arcing that causes fires. Accordingly, the electrical plug and receptacle 10 system is adapted to reduce electrically caused fires and to save property and lives.

Figure 4:
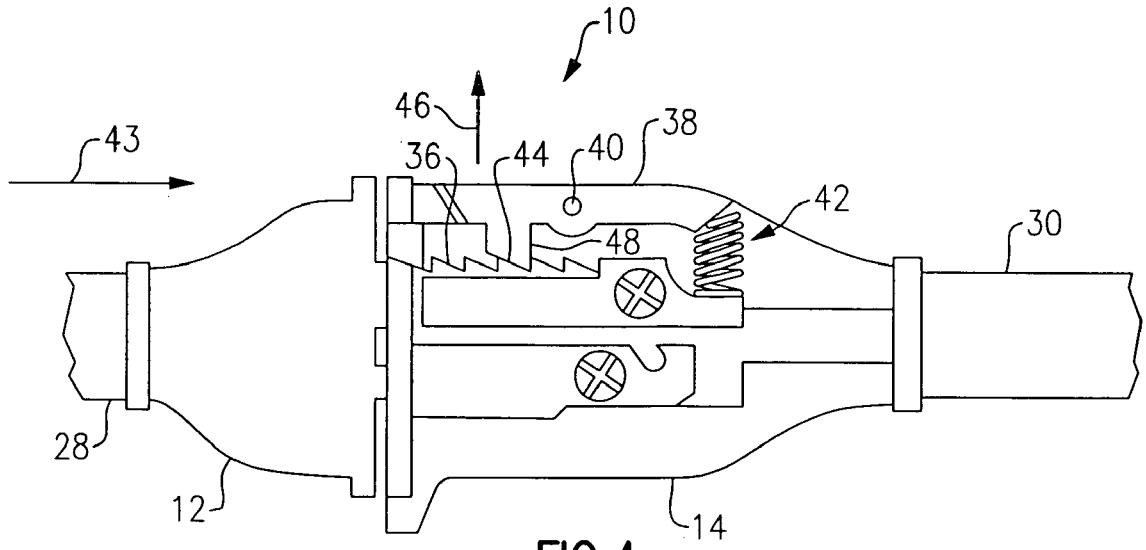
FIG. 4 is a partial cross-sectional view of the plug and receptacle of FIG. 1 with the plug inserted into the receptacle and with a retaining member securing the plug to the receptacle and with a first electrical cord attached to the plug and a second electrical cord attached to the receptacle.

A retaining member 38 adapted to pivot about an axis 40 is provided in the receptacle 14. A spring 42 supplies a biasing force sufficient to normally urge the retaining member 38 into a first position, as shown in FIG. 4, unless it is acted upon by an outside force or influence.

To use the electrical plug and receptacle 10 system, the plug 12 is simply inserted longitudinally, without rotation, into the receptacle 14, as shown by arrow 43.

When the pins 16–20 of the plug 12 are inserted into the sockets 22–26 of the receptacle, the leading incline edge of the serrated edge 36 contacts a retaining member incline 44. This contact forces that portion of the retaining member 38 that is disposed on the plug 12 side of the axis 40 to move in an upward direction, away from the receptacle 14, as shown by arrow 46.

The retaining member incline 44 includes a flat edge 48 facing toward the axis 40. As the end of the first sawtooth of the serrated edge 36 passes beyond the retaining member incline 44, the spring 42 urges the leading incline edge of the serrated edge 36 down, in a direction opposite arrow 46. The flat edge 48 bears against a flat portion of the first sawtooth of the serrated edge 36, thereby preventing removal of the plug 12 from the receptacle 14, should a force tending to urge the plug 12 in a direction opposite arrow 43 occur.

Accordingly, the first (one) sawtooth of the serrated edge 36 is sufficient to retain the plug 12 and receptacle 14 in both mechanical and electrical cooperation with each other.

Continued insertion of the plug 12 in the direction of arrow 43 repeats the process for each sawtooth of the serrated edge 36, progressively securing the plug 12 deeper in the receptacle 14. The plug 12, as shown in FIG. 4, is fully inserted into the receptacle 14 and is secured thereto.

Should the plug 12 be tugged in a direction opposite arrow 43 during normal use of the device (that is attached to an opposite end of the first electrical cord 28), the plug 12 is retained in mechanical, and therefore also electrical cooperation, with the receptacle 14. This not only increases safety but it also increases throughput (because the user does not have to stop using the device, walk back to the plug 12, and reconnect it to the receptacle 14, and then walk back to the device and resume work after inadvertent disconnects have occurred).

It is noted that securement occurs automatically. It is not necessary to rotate the plug 12 relative to the receptacle 14 or perform any other operation. The plug 12 is inserted linearly and without abnormal or additional motion into the receptacle 14 and securement occurs automatically.

To remove the plug 12 apart from the receptacle 14, a deliberate additional step is required. The user presses down on a rear portion of the retaining member 38 that is disposed opposite the plug 12 side of the axis 40 sufficient to compress the spring 42 and to raise the retaining member incline 44 and the flat edge 48 above the top of the serrated edge 36. This is shown in FIG. 3 and is referred to as a second position for the retainer member 38.

While holding the retaining member 38 as shown in FIG. 3, the plug 12 can then be easily linearly withdrawn apart from the receptacle 14 by urging the plug 12 in a direction opposite that of arrow 43.

Again, no rotation or other motion of the plug 12 relative to the receptacle 14 is required for separation other than depression of the retaining member 38, as described above. This provides for easy, rapid separation when that is desired while preventing inadvertent separation when that is not required.

Figure 5:
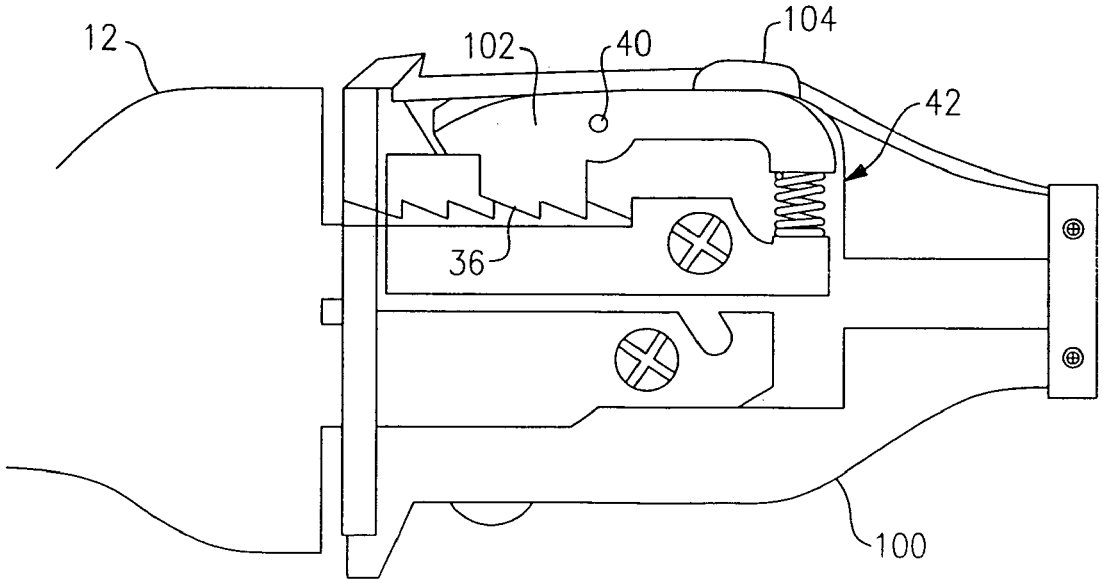
FIG. 5 is a partial cross-sectional view of the plug and a modified type of receptacle with the plug inserted into the modified receptacle and with a modified retaining member securing the plug to the receptacle.

Referring now also to FIG. 5 is shown in a partial cross-sectional view the plug 12 inserted into a modified type of receptacle 100. A modified retaining member 102 includes a protrusion 104 attached to an upper surface thereof. A hole is provided in a surface of the modified receptacle 100 to permit a portion of the protrusion 104 to extend therefrom.

A remainder of the modified retaining member 102 is disposed under the surface of the modified receptacle 100. This permits better environmental sealing of an interior of the modified receptacle 100 to occur and may be preferred to certain applications of the electrical plug and receptacle 10 system.

To further aid in securing the plug 12 to the modified receptacle 100, the modified retaining member 102 is further modified, as desired, to include a plurality of retaining member inclines 44 and the flat edges 48 are arranged in an adjacent longitudinal fashion, each one engaging with one of the sawtooths of the serrated edge 36.

Figure 6:
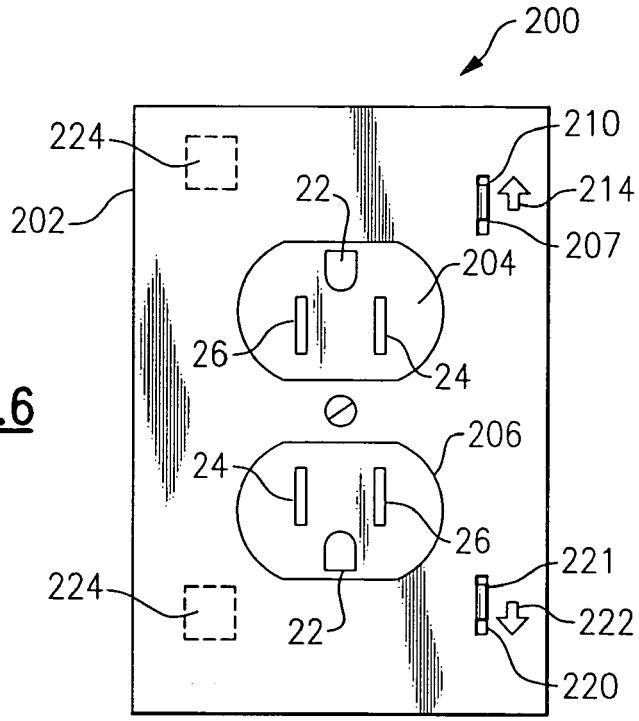
FIG. 6 is a front view of a duplex type of a ratcheting electrical receptacle.
Figure 7:
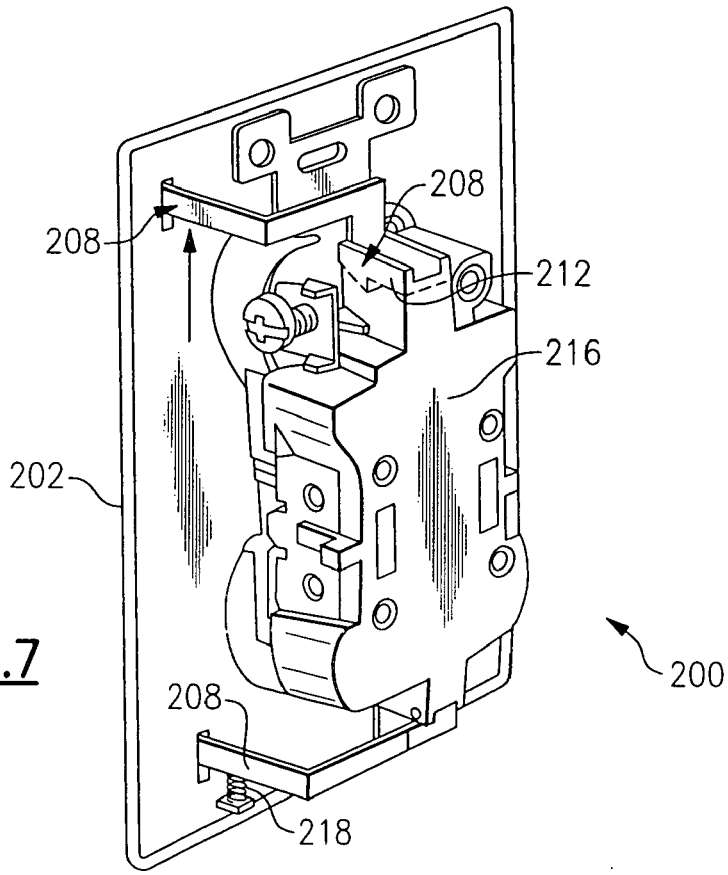
FIG. 7 is a view in perspective of a rear of the duplex ratcheting electrical receptacle of FIG. 6 with a pair of second modified retaining members.
Figure 8:
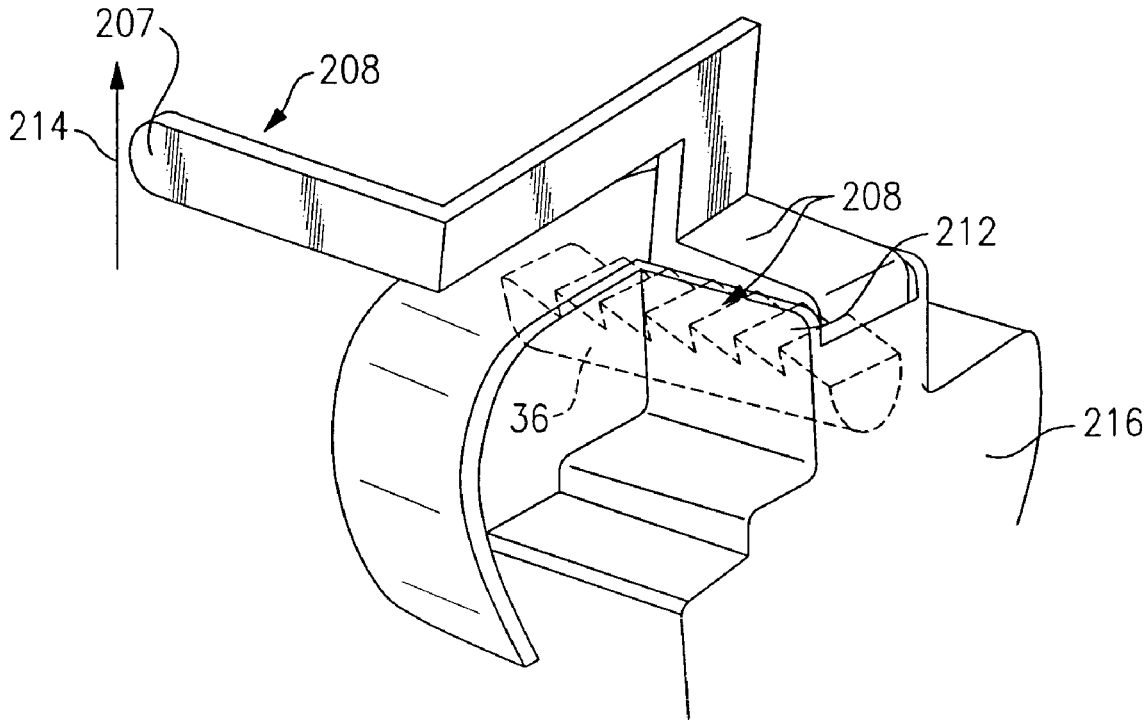
FIG. 8 is an enlarged view in perspective of a portion of the duplex ratcheting electrical receptacle of FIG. 6.

Referring now also to FIGS. 6–8 are shown a front, rear perspective, and enlarged rear perspective views of the duplex type of a ratcheting electrical receptacle 200. The duplex type of a ratcheting electrical receptacle 200 operates to secure the plug 12 in similar manner as does the receptacle 14. A type of construction for the duplex type of a ratcheting electrical receptacle 200 is described in greater detail hereinafter.

The duplex type of a ratcheting electrical receptacle 200 is shown to illustrate an adaptation of the receptacle portion of the electrical plug and receptacle 10 system for use in a fixed-in-position type of application and installation.

The duplex type of a ratcheting electrical receptacle 200 is intended to replace, where desired, a prior art type of a duplex receptacle (not shown) as is found in virtually every home and office in the U.S.

A beauty of the duplex type of a ratcheting electrical receptacle 200 is that it readily accepts prior art types of plugs, although securement other than by friction (which is the prior art way) is not possible when the prior art type of plug is used. Therefore, old types of plugs are compatible for use with the duplex type of a ratcheting electrical receptacle 200.

This means a table lamp, for example, with an old style plug (typically two prong with no ground) can be attached to one-half of the duplex type of a ratcheting electrical receptacle 200 and retained in place normally by friction. Because the lamp is seldom moved, there is usually no tugging of the old style plug and no tendency for it to be pulled out of the duplex type of a ratcheting electrical receptacle 200, anymore than there is with table lamps that are plugged into current types of prior art duplex receptacles. Prior art types of three prong (with ground) 120 VAC plugs are also compatible for use with the duplex type of a ratcheting electrical receptacle 200 using friction-only retention means.

However, a vacuum cleaner can be intermittently attached to the remaining unused half of the duplex type of a ratcheting electrical receptacle 200 whenever cleaning is required. The vacuum, ideally, would include the new style of the plug 12 and, as is described below, would be held in cooperation with the duplex type of a ratcheting electrical receptacle 200 even if the vacuum's cord was tugged.

This illustrates some of the versatility of the electrical plug and receptacle 10 system, in general, and of the duplex type of a ratcheting electrical receptacle 200 in particular.

The duplex type of a ratcheting electrical receptacle 200 includes a faceplate 202 and an upper socket 204 and a lower socket 206. An exposed end 207 of a second modified retaining member 208 extends through an upper slot 210 in the faceplate 202.

The second modified retaining member 208 includes a rear pivot axis 212. Gravity keeps the exposed end 207 urged down in the upper slot 210 ready to engage and receive the plug 12 as was previously described.

To release the plug 12, the exposed end 207 is urged in the direction as shown by arrow 214 sufficient to urge the second modified retaining member 208 from the first position into the second position, and the plug 12 is then easily pulled out of the upper socket 204.

FIG. 8 also shows the serrated edge 36 of the ground pin 16 of the plug 12 in cooperation with the second modified retaining member 208, securing the plug 12 thereto.

The lower socket 206 is shown in an opposite orientation with respect to the upper socket 204. This is done to orient both of the ground sockets 22 proximate a top and bottom of a specially modified duplex receptacle 216 of the duplex type of a ratcheting electrical receptacle 200.

The second modified retaining member 208 is identical for use with either the upper socket 204 or the lower socket 206 except that a modified spring 218 is required to supply a force to urge the second modified retaining member 208 of the lower socket 206 into the first position.

To release the plug 12 from the lower socket 206 a lower socket exposed end 220 that passes through a lower slot 221 is urged in the direction as shown by arrow 222 into the second position and the plug 12 is withdrawn. When pressure is released from the lower socket exposed end 220 the modified spring 218 urges the lower second modified retaining member 208 back into the first position.

It is of course possible to alter the modified duplex receptacle 216 to allow both the upper and lower sockets 204, 206 to face in the same direction, as is common with prior art types. It is also possible to further modify and internally connect the pair of second modified retaining members 208 together so that their movement is synchronized. Accordingly, only one slot (either 210 or 221) with only one exposed end (207 or 220) would be required to initiate release of the ratcheting portion of any plugs 12 that are disposed in either or both the upper and lower sockets 204, 206.

The advantage provided by having only one slot and only one exposed end is speed of release of one or two plugs 12 simultaneously. The advantage provided by having two slots and two exposed ends is that release of one plug 12 can occur while secure retention of another plug 12 (that is also disposed in the same duplex type of a ratcheting electrical receptacle 200) can occur simultaneously.

It is also possible to include fixed-in-place additionally modified receptacles that are not "duplex" but which only include one particular receptacle configuration of the electrical plug and receptacle 10 system, for example a 240 VAC 50 ampere range connection, as is used to connect most common types of electric ranges or welders to electrical power.

A ground pin, preferably, of the 240 VAC 50 ampere range connection would include the serrated edge 36 and would cooperate with a modified ground socket that included an appropriately designed retaining member that was adapted to engage with the sawtooth pattern of the serrated edge 36.

Certainly, countless other variations are possible to those having ordinary skill in the art after first having had benefit of the instant disclosure.

For example, the duplex type of a ratcheting electrical receptacle 200 can be modified to include one or more push buttons 224 of any preferred shape in the faceplate 202 that, when depressed, also displace either the second modified retaining member 208 or the lower second modified retaining member 208 from the first position into the second position, adapted for release of the plug 12.

The push buttons 224, when used, replace the exposed end 207 and the upper slot 210 and the lower socket exposed end 220 and the lower slot 221. If preferred, only one push button 224 can be included to simultaneously affect release of the plugs 12 disposed in either or in both the upper and lower sockets 204, 206.

In normal use, when the plug 12 is inserted into the receptacle 14 or alternately into either the upper or lower socket 204, 206, each of the longitudinal adjacent sawtooth profiles of the serrated edge 36 successively pass the (type of) retaining member 38, 208 causing it to repeatedly ratchet up and down as it engages in turn with each particular passing sawtooth until eventually the plug 12 is fully inserted and engagement with the last sawtooth has occurred. Ideal electrical connection between the electrically conductive pins 16, 18, 20 and the sockets 22, 24, 26 is provided.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An electrical plug and receptacle, comprising:

(a) a plug including at least one electrically conductive pin extending saidrefrom;

(b) a receptacle correspondingly configured to cooperate with said at least one electrically conductive pin of said plug; and wherein said pin is configured to be inserted linearly into a portion of said receptacle to establish electrical continuity between said pin and said portion of said receptacle, and wherein said pin is adapted to be withdrawn linearly from said portion of said receptacle to cease electrical continuity between said pin and said portion of said receptacle; and (c) wherein said pin includes first means for retaining said pin in said portion of said receptacle, and wherein said receptacle includes second means for retaining said pin in said portion of said receptacle, and wherein said second means includes a first position and a second position, and wherein said first position is a normal position and wherein said second position is a temporary position that requires a displacement of a portion of said second means and wherein subsequent to a removal of said displacement of said portion of said second means, said second means automatically returns to said first position, and wherein said first means and said second means cooperate when said second means is disposed in said first position sufficient to permit said pin to be linearly inserted into said portion of said receptacle not only fully but also a partial amount into said receptacle, and wherein said first means and said second means prevent said pin from being linearly withdrawn from said portion of said receptacle when said second means is disposed in said first position, including when said pin is not only fully but also partially inserted into said receptacle, and wherein when said second means is disposed in said second position, said first means and said second means permit said linear withdrawal of said pin from said portion of said receptacle.

2. The electrical plug and receptacle of claim 1 wherein said first means includes a serrated edge disposed on a portion of said pin.

3. The electrical plug and receptacle of claim 2 wherein said serrated edge includes at least one sawtooth shaped profile.

4. The electrical plug and receptacle of claim 2 wherein said serrated edge includes a plurality of sawtooth shaped profiles that are adjacent to each other and which extend along a surface of said pin for a predetermined longitudinal distance.

5. The electrical plug and receptacle of claim 1 wherein said pin includes a ground pin.

6. The electrical plug and receptacle of claim 1 wherein said second means includes a retaining member disposed in said receptacle, said retaining member normally disposed in said first position and capable of being urged into said second position, and wherein said retaining member includes means for engaging with said first means sufficient to retain said pin in said portion of said receptacle when said retaining member is disposed in said first position.

7. The electrical plug and receptacle of claim 6 wherein said means for engaging with said first means for retaining said pin in said portion of said receptacle includes ratchet means.

8. The electrical plug and receptacle of claim 7 wherein said ratchet means includes a serrated edge disposed on a portion of said pin and means attached to said retaining member for engaging with a portion of said serrated edge.

9. The electrical plug and receptacle of claim 1 wherein said plug is attached to an end of an electrical cord.

10. The electrical plug and receptacle of claim 9 wherein said electrical cord includes an extension cord.

11. The electrical plug and receptacle of claim 1 wherein said receptacle is attached to an end of an electrical cord.

12. The electrical plug and receptacle of claim 11 wherein said electrical cord includes an extension cord.

13. The electrical plug and receptacle of claim 1 wherein said receptacle is fixed in position.

14. The electrical plug and receptacle of claim 13 wherein said receptacle includes a duplex receptacle.

15. The electrical plug and receptacle of claim 1 wherein said portion of said receptacle that is configured to receive said pin includes an electrical socket.

* * * * *